US006708707B2

(12) United States Patent
Dotterweich et al.

(10) Patent No.: US 6,708,707 B2
(45) Date of Patent: Mar. 23, 2004

(54) COLLAPSIBLE CANOPY SUPPORT

(76) Inventors: Martin J. Dotterweich, 502 Rancho La Mirada La., Escondido, CA (US) 92025; Gilbert O. Martin, Jr., 10845 Bennett Dr., Fontana, CA (US) 92337

( * ) Notice: Subject to any disclaimer, the term of this patent is extended or adjusted under 35 U.S.C. 154(b) by 0 days.

(21) Appl. No.: 10/100,573

(22) Filed: Mar. 15, 2002

(65) Prior Publication Data

US 2003/0172966 A1 Sep. 18, 2003

Related U.S. Application Data

(60) Provisional application No. 60/351,964, filed on Jan. 25, 2002.

(51) Int. Cl.[7] ..... E04H 15/50

(52) U.S. Cl. ..... 135/131; 135/146; 135/145; 135/159

(58) Field of Search ..... 135/131, 145, 135/146, 147, 158, 159, 160; 52/646

(56) References Cited

U.S. PATENT DOCUMENTS

| | | | | | |
|---|---|---|---|---|---|
| 4,607,656 | A | | 8/1986 | Carter | |
| 4,641,676 | A | | 2/1987 | Lynch | |
| 4,779,635 | A | | 10/1988 | Lynch | |
| 4,885,891 | A | * | 12/1989 | Lynch | 52/646 |
| 4,947,884 | A | | 8/1990 | Lynch | |
| 5,244,001 | A | | 9/1993 | Lynch | |
| 5,274,980 | A | * | 1/1994 | Zeigler | 52/646 |
| 5,275,188 | A | * | 1/1994 | Tsai | 135/97 |
| 5,421,356 | A | | 6/1995 | Lynch | |
| 5,485,863 | A | | 1/1996 | Carter | |
| 5,490,532 | A | * | 2/1996 | Mallookis et al. | 135/117 |
| 5,511,572 | A | | 4/1996 | Carter | |
| 5,632,292 | A | | 5/1997 | Carter | |
| 5,632,293 | A | | 5/1997 | Carter | |
| 5,634,483 | A | * | 6/1997 | Gwin | 135/131 |
| 5,794,546 | A | | 8/1998 | Carter | |
| 5,794,640 | A | * | 8/1998 | Jang | 135/131 |
| 5,797,412 | A | | 8/1998 | Carter | |
| 5,921,260 | A | | 7/1999 | Carter | |
| 6,206,020 | B1 | * | 3/2001 | Lynch | 135/128 |
| 2002/0074032 | A1 | * | 6/2002 | Park et al. | 135/131 |
| 2003/0024563 | A1 | * | 2/2003 | Liu | 135/131 |

* cited by examiner

*Primary Examiner*—Robert Canfield
(74) *Attorney, Agent, or Firm*—Calif Tervo

(57) ABSTRACT

A collapsible support (10) for a canopy (15) comprises a peripheral structure (20) and a central structure (60). Peripheral structure (20) includes four telescopingly collapsible legs (21), each having a sliding member (35) slidingly connected thereto and four pairs (40P) of X-configured truss structures (41) connecting legs (21). Central structure (60) connects between opposite side X-configured truss structure pairs (40P) and is supported thereby. Central structure (60) generally includes a center post assembly (61) supported by two pairs of orthogonal center trusses (80). Canopy (15) is attached to peripheral structure (20) so as to tension canopy (15) over center post assembly (61) in an erect configuration.

26 Claims, 3 Drawing Sheets

COLLAPSIBLE CANOPY SUPPORT

CROSS-REFERENCE TO RELATED APPLICATIONS

This application claims the benefit of a U.S. Provisional Application serial No. 60/351,964 filed Jan. 25, 2002.

FIELD OF THE INVENTION

This invention relates in general to a collapsible support structure and canopy, and more specifically involves a strong, rigid structure with the center of the ceiling being higher than the peripheral support structure.

BACKGROUND OF THE INVENTION

Conventional collapsible shelters have several shortcomings. They have lateral side structure that does not provide adequate stiffness to resist side forces such as wind. Thus, in heavy wind, they tend to move or oscillate. Such movement is annoying and can lead to wear and failure. If the ceiling support members of conventional collapsible supports are loaded, such as by roof loads or by hanging items below, the ceiling members either buckle downward and/or bow out the side lateral support structure; both undesirable. Conventional collapsible supports have low support structure in the center of the ceiling. This may cause claustrophobic feeling in persons under the canopy. Conventional collapsible supports do not support a canopy such that it readily sheds water or debris. Additionally, they are not structurally strong enough to support loads suspended from the center structure.

Therefore, there has been a need for a collapsible support for a canopy providing rigid ceiling support that will carry roof loads and interior loads without failure or without buckling the side structure.

Therefore, there has been a need for a collapsible support for a canopy providing stiffness to the lateral side structures such at they do not move or oscillate in heavy wind.

Preferably, such a cover also provides a ceiling having a high center that is strong enough to support loads from the center structure.

SUMMARY OF THE INVENTION

This invention is a collapsible canopy support and it generally comprises a peripheral structure and a central structure. The peripheral structure comprises four telescopingly collapsible legs, each having a sliding member slidingly connected thereto and four pairs of X-configured truss structures connecting said legs. Each X-configured truss structure includes a first link including a proximal end pivotally connected to a leg upper portion top end, a distal end pivotally connected to the distal end of the first link of the other X-configured truss structure of the pair, and a center portion therebetween; and a second link including a proximal end pivotally connected to the leg sliding member, a distal end pivotally connected to the distal end of the second link of the other X-configured truss structure of the pair, and a center portion therebetween pivotally connected to the center portion of the first link.

The central structure connects between opposite side X-configured truss structure pairs and is supported thereby. The central structure generally includes a center post assembly supported by two pairs of orthogonal center trusses. Each pair of center trusses is connected to the center of opposite side X-configured truss structure pairs and is supported thereby.

The center post assembly includes a telescoping center post that is adjustable in length and a center slider member adapted to slide over the center post. A slider stop stops further downward movement of the slider member.

Each center truss includes a long link, an outer link, and an inner link. The long link is longer than half the width of the support and is longer than the first link and includes an outer end pivotally connected to said distal ends of the first links and an inner end pivotally connected to the center slider member. The outer link includes an outer end pivotally connected to the distal ends of the second links and an inner end pivotally connected to the midsection of the long link such that the length of the outer link plus the length of the outer portion of the long link approximates the combined length of the first link and said second link from their proximal ends to their pivot connection The inner link is less than half the length of said first link and includes an outer end pivotally connected to the midsection of the long link and an inner end pivotally connected to the lower portion of the center post.

The canopy periphery is attached to the peripheral structure so as to tension the canopy over the center post assembly.

The features and advantages of the invention will be readily understood when the detailed description thereof is read in conjunction with the accompanying drawings wherein like reference numerals refer to like parts throughout.

DETAILED DESCRIPTION OF THE INVENTION

Figure 1:
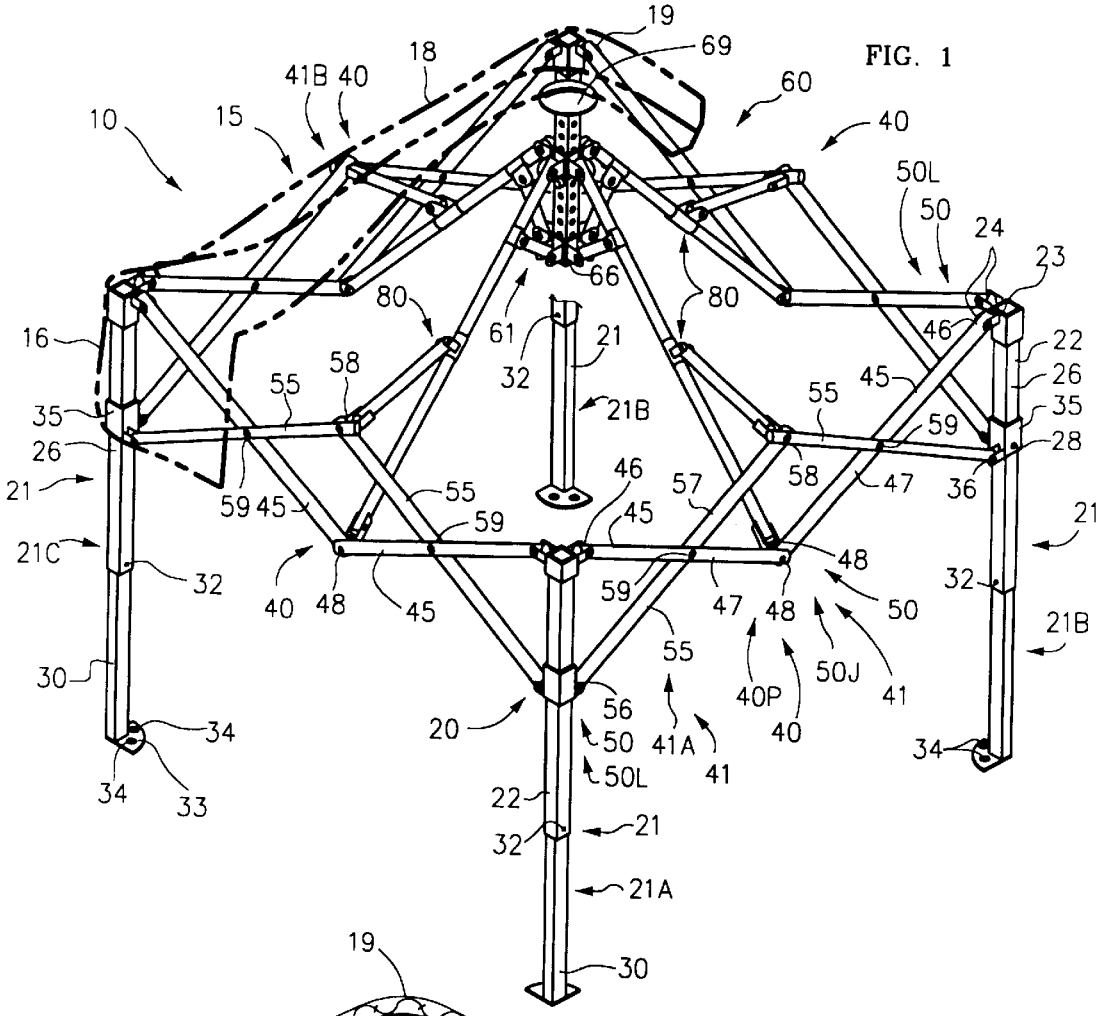
FIG. 1 is a partially cut away perspective view of an exemplary embodiment of the collapsible canopy of the invention, with a portion of the canopy shown in phantom.

With reference now to drawing FIGS. 1–4, FIG. 1 is a partially cut away perspective view of an exemplary embodiment of the collapsible canopy support 10 of the invention in the erect position. Support 10 is configurable from a collapsed position to an erect position. Support 10 generally comprises a peripheral structure 20 and a central structure 60, including a center post assembly 61, for supporting a canopy 15.

Figures 2, 3, 4, 6, 7:
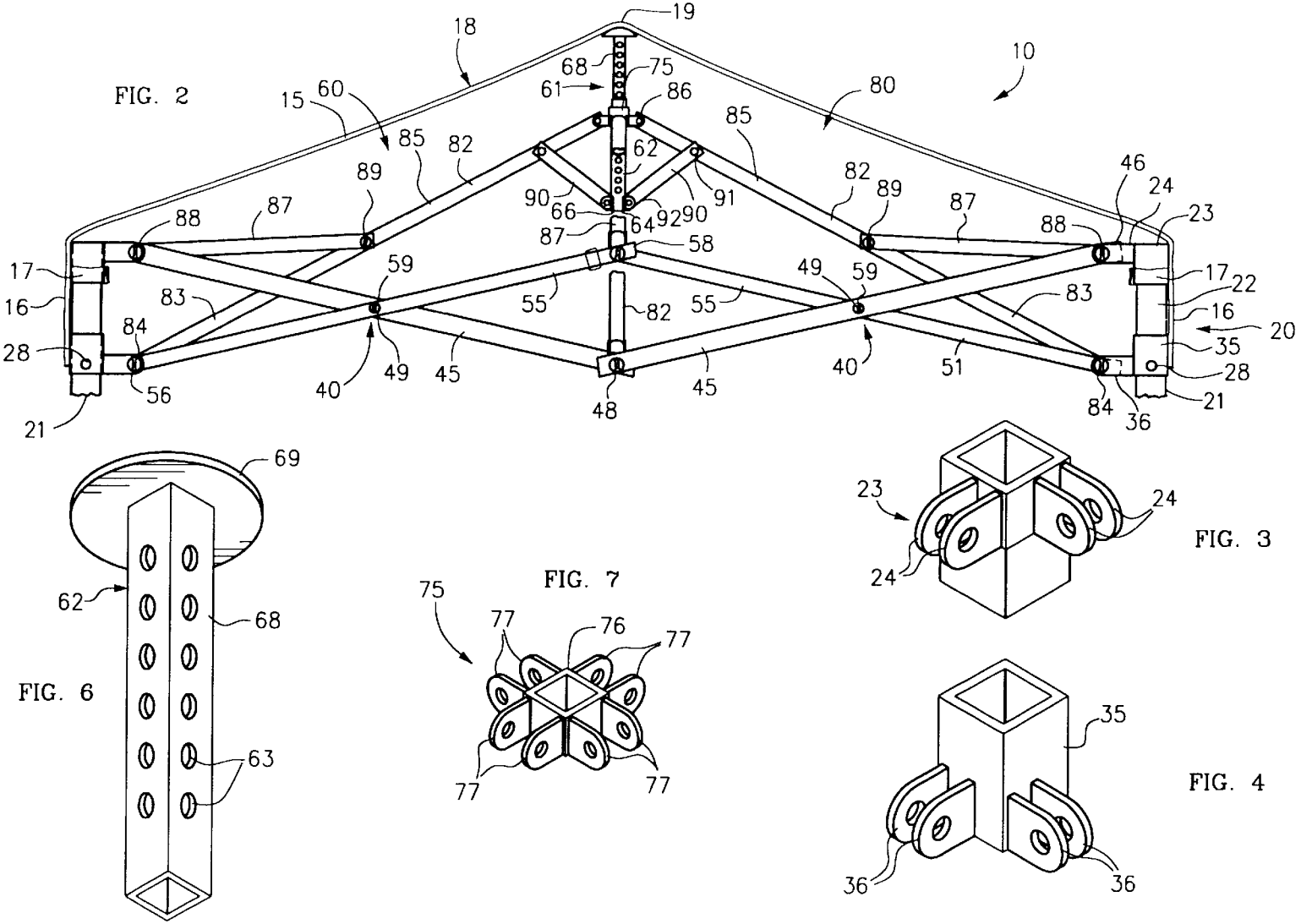
FIG. 2 is a partially cut away side elevation sectional view of the central structure of FIG. 1.
FIG. 3 is an enlarged perspective view of the top end of a leg of FIG. 1.
FIG. 4 is an enlarged perspective view of a leg slider collar of FIG. 1.
FIG. 6 is an enlarged perspective view of the telescoping member of the center post of FIG. 5.
FIG. 7 is an enlarged perspective view of the center slider member of FIG. 5.

FIG. 2 is a partially cut away side elevation sectional view of central structure 60 of FIG. 1. FIG. 3 is an enlarged perspective view of the top end 23 of a leg 21 of FIG. 1. FIG. 4 is an enlarged perspective view of a leg slider collar 35 of FIG. 1.

Peripheral structure 20 includes four legs 21, four sliding collars 35, and four pairs 40P of X-configured truss structures 41 connecting legs 21.

Legs 21 are mainly comprised of square metal tube. Each leg 21 includes an upper portion 22 and a lower portion 30. Upper portion 22 has a top end 23 and a central portion 26 below top end 23. As best seen in FIG. 3, top end 23 includes flanges, such as clevis flanges 24. Four sliding members, such as collars 35, are slidingly connected to leg central portion 26. As best seen in FIG. 4, sliding collars 35 include flanges, such as clevis flanges 36. Although collars 35 are shown and described, other sliding devices coupling the structural members in a similar functional relationship are known and may be used instead of collars 35. Each leg 21 includes means, such as abutment or detent button 28, well known in the art, which is spring biased and protrudes from leg 21 through a bore 37 in sliding collar 35 for maintaining sliding collar 35 in the erect position or may be pushed inward to disengage from sliding collar 35 for moving sliding collar 35 to the collapsed position.

Figure 8:
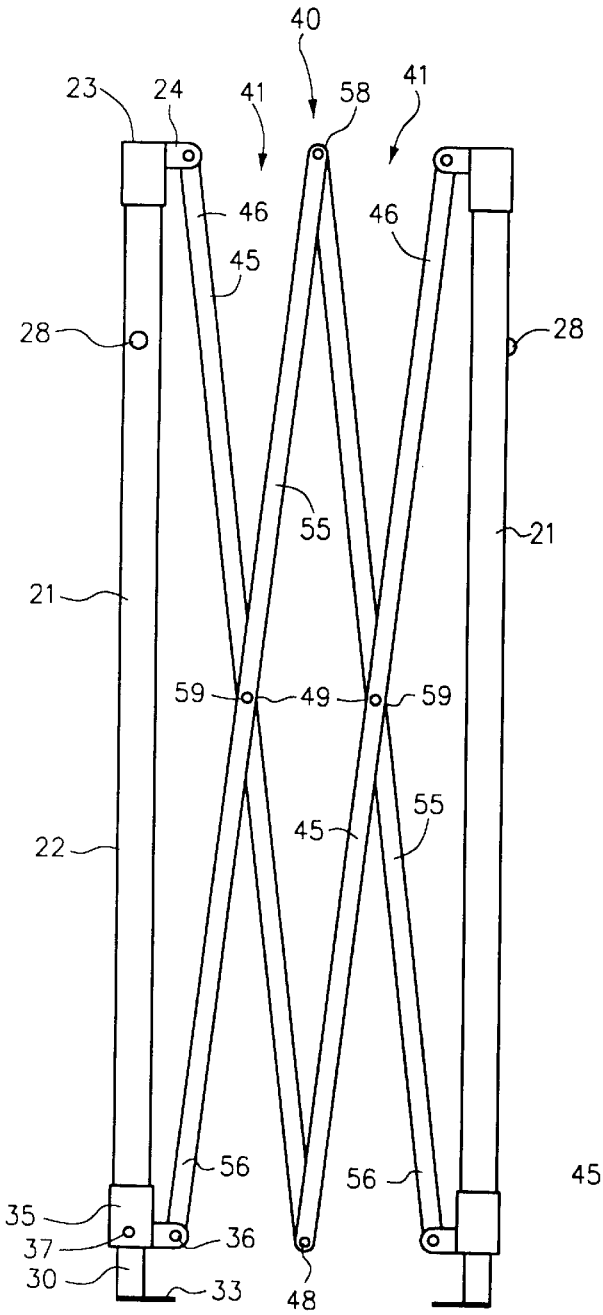
FIG. 8 is a side elevation view of the peripheral structure of the canopy support of FIG. 1 in a collapsed condition; the other sides being identical.

Leg lower portion 30 engages the ground. Preferably, upper portion 22 and lower portion 30 are telescoping such that lower portion 30 is the inner portion and retracts into upper portion 22 in the collapsed position, as seen in FIG. 8. Releasable locking means, such as detent button 32, as is well known in the art, on lower portion 30 maintains lower portion 30 in the erect position and is pressed to retract lower portion 30 into upper portion 22. A foot flange 33 on bottom end of leg lower portion 30 spreads out the weight on the ground. A pair of bores 34 through foot flange 33 receive ground anchors, such as pegs or tie downs.

Side structures 40, each comprising a plurality of X-configured truss structures 41, such as pairs 40P of X-configured truss structures 41, connect pairs of adjacent legs 21 and hold the upper portion of legs 21 parallel. Each X-configured truss structure pair 40P joins two adjacent legs 21, such as legs 21A, 21B of first adjacent pair and legs 21C, 21D of second adjacent pair. Each X-configured truss structure 41 comprises two structural members: a first link 45 and a second link 55. First link 45 includes a proximal end 46, a distal end 48, and a center portion 47 therebetween. As best seen in FIG. 2, proximal end 46 is pivotally connected to flange 24 on a leg upper portion top end 23. Distal end 48 is pivotally connected to distal end 48 of first link 45 of the other X-configured truss structure 41 of pair 40P. Second link 55 includes a proximal end 56, a distal end 58 and a center portion 57 therebetween. Proximal end 56 is pivotally connected to flange 36 on leg sliding member 35. Distal end 58 is pivotally connected to distal end 58 of second link 55 of the other X-configured truss structure 41 of pair 40P. First link 45 and second link 55 are pivotally connected, such as by a pivot pin 59, such as at midpoints 49, to form an X. Each X-configured truss structure 41 has lateral ends 50 each comprising an upper end of one link and a lower end of the other link. At least one lateral end 50 is a joining lateral end 50J wherein the upper end and the lower end respectively are pivotally connected to an upper end and a lower end of a joining lateral end 50J of another X-configured truss member. Each side structure 40 includes a pair of leg X-configured truss structures; one leg X-configured truss structure being attached to each leg 21. A lateral end 50 of each leg X-configured truss structure being a leg lateral end 50L wherein the upper end is pivotally connected to leg upper portion top end 23 and the lower end is pivotally connected to leg sliding member 35. Returning momentarily to FIGS. 3 and 4, flanges 36 on leg slider collar 35 are laterally offset from flanges 24 on leg top end 23 so that links 45, 55, remain parallel in top view. Preferably, all links 44, 55 are the same length. Legs 21 and four pairs 40P of X-configured trusses 41 support the periphery 16 of canopy 15.

Figure 5:
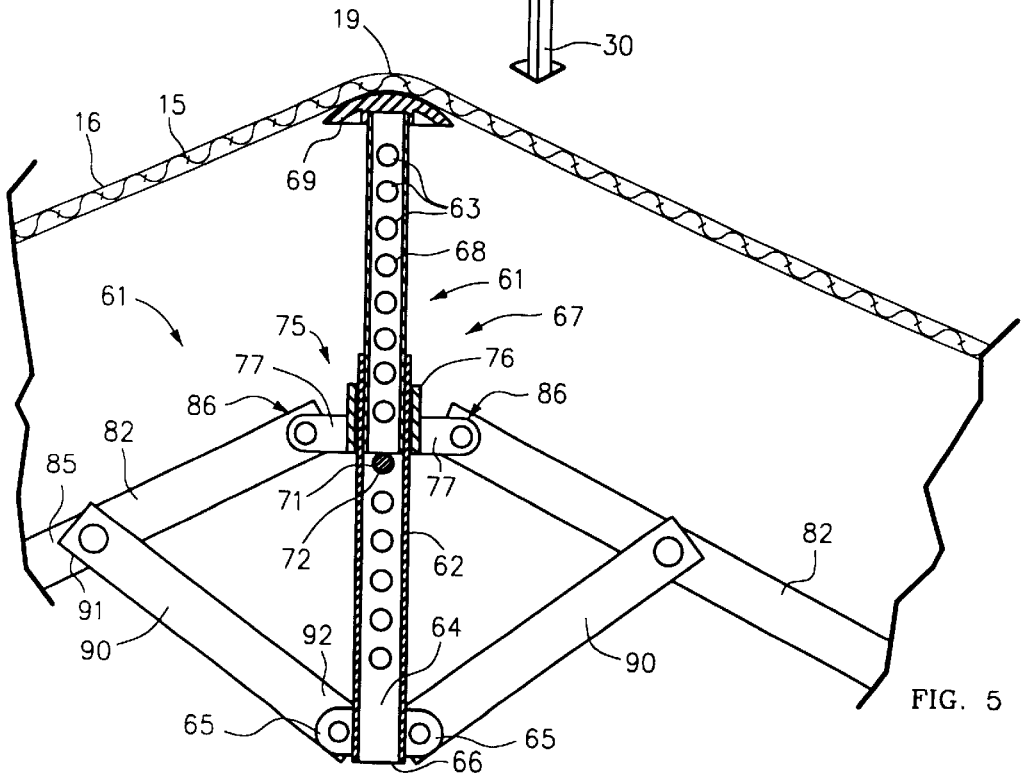
FIG. 5 is an enlarged side sectional view of the center post assembly of FIGS. 1 and 2.

Central structure 60 connects between opposite side X-configured truss structure pairs 40P and is supported thereby. Central structure 60 generally comprises a center post assembly 61 and two pairs of center trusses 80 supporting center post assembly 61. Central structure 60 is best described with respect to FIGS. 2, 5, 6, and 7. FIG. 2 is a partially cut away side elevation sectional view of central structure 60 of FIG. 1. FIG. 5 is an enlarged side sectional view of center post assembly 61 of FIGS. 1 and 2. FIG. 6 is an enlarged perspective view of the telescoping member 68 of the center post of FIG. 5. FIG. 7 is an enlarged perspective view of the center slider member 75 of FIG. 5.

Center post assembly 61 includes center post 62 and center slider member 75. Center post 62 is a square metal tube that has a plurality of vertically spaced horizontal bores 63 therethrough and includes a lower portion 64 and an upper portion 67. Lower portion 64 includes a plurality of flanges, such as clevis flanges 65; and has a lower terminus 66.

Best seen in FIG. 5, upper portion 67 includes a center post slider stop 71, such as bolt 72 through one of bores 63, for preventing sliding member 75 from further sliding down center post 62. This is critical for structural integrity. Preferably, downward movement of sliding member 75 is stopped such that the supporting pairs 40P of X-configured truss structures 41 are not bowed outward. Slider stop 71, in effect, fixes the angle between long link 82 and center post assembly 61 such that central structure 60 will not bow out supporting pairs 40P if canopy 18 roof is loaded or if long link 82 is loaded.

Upper portion 67 includes a telescoping member 68 adapted for sliding into the remainder of post 62. Telescoping member 68 has an upper end 69 adapted, such as by having a large smooth curved area, for supporting the apex 19 of canopy 15. Bolt 72 may be passed through bore 63 in telescoping member 68 to maintain telescoping member 68 at a desired height or to change the height to further tension canopy 15. Of course, many other means may be used to adjust the height of upper end 69.

As best seen in FIG. 7, center slider member 75 is a collar 76 in the exemplary embodiment and includes four pairs of clevis flanges 77. Center post slider collar 76 is adapted to slide over center post 62 and to be stopped from further downward movement by slider stop 71, such as stop bolt 72. Although collar 76 is shown to perform the described function, other sliding pivotal connection means could be used.

As best seen in FIG. 1, a pair of center trusses 80 are connected to opposite side X-configured truss structure pairs 40P and supported thereby. Each center truss 80 comprises three structural members: a long link 82, an outer link 87, and an inner link 90. Long link 82 includes an outer portion 83 having an outer end 84, an inner end 86, and a midsection 85 therebetween. Outer end 84 is pivotally connected to distal ends 48 of first links 45 of an X-configured truss structure pair 40P. Inner end 86 is pivotally connected to flange 77 of center slider member 75. Preferably, long link 82 is longer than second link 55 and.

Figure 9:
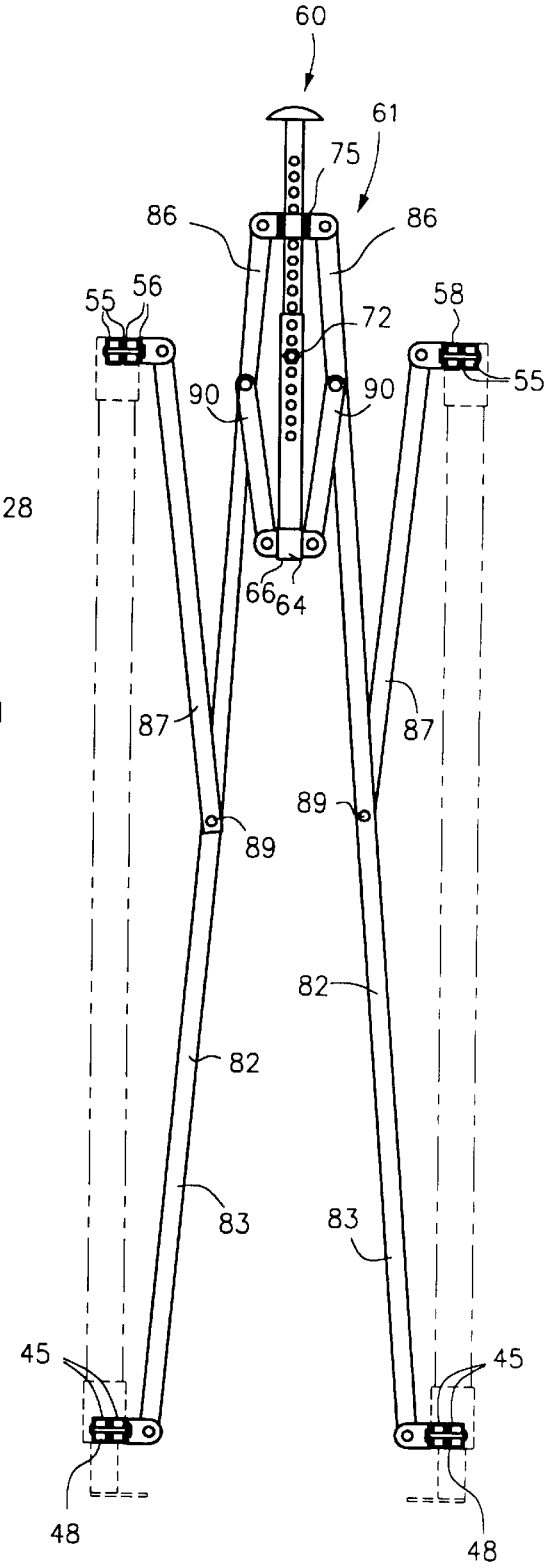
FIG. 9 is a sectional side elevation view of a portion of the central structure of the canopy support of FIG. 1 in collapsed condition; an orthogonal section being identical.

Outer link 87 includes an outer end 88 and an inner end 89. Outer end 88 is pivotally connected to distal ends 58 of second links 55 of the X-configured truss structure pair 40P. Inner end 89 is pivotally connected to midsection 85 of long link 82, defining the portion of long link 82 peripheral to this pivot as outer portion 83 of long link 82. Comparing FIGS. 8 and 9, outer link 86 is seen to be dimensioned such that the length of outer link 86 plus the length of outer portion 83 of long link 82 is substantially equal to the combined lengths of links 45, 55 between proximal ends 46, 56 and pivot pins 59 so as to allow collapse of support 10.

Inner link 90, seen in FIGS. 2 and 5, includes an outer end 91 and an inner end 92. Outer end 91 is pivotally connected to midsection 85 of long link 82 central from inner end 86 of long link 82. Inner end 92 is pivotally connected to clevis flanges 65 on lower portion 64 of center post 62.

As best seen in FIG. 2, in the preferred embodiment in the erect configuration, lower terminus 66 of center post assembly 61 is higher than distal ends 48 of first links 45. This provides for a higher center to the interior ceiling and more head room and spacious interior to the shelter. Also, as best seen in FIG. 2, in the preferred embodiment in the erect configuration, inner ends 86 of long link 82 are above distal ends 58 of second links 55. This provides for an arched roof which is structurally stronger than a flat roof and for a domed canopy 15 that more readily sheds precipitation.

Canopy 15 includes a periphery 16 and a roof 18. Canopy 15 is attached, such as by velcro straps 17 on periphery 16 to peripheral structure 20, such as to upper portion 22 of legs 21 and to distal ends 58 of second links 55, such that, in the erect configuration, canopy apex 19 is tensioned over center post assembly 61, thereby pushing center post 62 downward. This downward tensioning, combined with the action of slider stop, provides for a very rigid central structure such that the supporting pairs 40P of X-configured truss structures are not bowed inwardly or outwardly as loads are placed on canopy roof 18 or on long link 82.

Having described the invention, it can be seen that it provides a very convenient canopy support that can be easily and quickly collapsed and placed in a small space, such as the trunk of an automobile. The center of the ceiling is higher than the periphery to provide a spacious interior. The center structure is rigid to provide load bearing and lateral center support for the lateral peripheral structure. The center post length is adjustable to tension a canopy and provide improved run-off.

Although a particular embodiment of the invention, employing four legs 21 and having two pairs 40P of X-configured truss structures joining legs 21, has been illustrated and described, it is readily seen that support 10 may be comprised of multiples of these units so as to have more than four legs 21, more than a pair of X-configured truss members 41 per side structure 40, and more than a single center post assembly 61. Thus, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A collapsible canopy support comprising:

a plurality of legs; each leg including:

an upper portion including;

a top end;

a central portion below said top end;

a lower portion for engagement with the ground; and a sliding member slidingly connected to said leg central portion;

said plurality of legs including:

a first pair of adjacent legs including:

a first leg; and a second leg; and a second pair of adjacent legs including:

a first leg; and a second leg;

a plurality of side structures; each side structure joining two legs and including:

a plurality of X-configured truss structures; each X-configured truss structure comprising:

a first link including:

an upper end;

a lower end; and a center portion;

a second link including:

an upper end;

a lower end; and a center portion pivotally connected to said center portion of said first link; such that each X-configured truss structure has lateral ends; each said lateral end comprising an upper end of one said link and a lower end of the other said link; said plurality of X-configured truss structures including:

a first side structure of a first plurality of said X-configured truss structures connecting said first pair of adjacent legs; at least one said lateral end of each of said first plurality being a joining lateral end wherein said upper end and said lower end respectively are pivotally connected to a said upper end and a said lower end of a joining lateral end of another of said first plurality; said first plurality including a pair of leg X-configured truss structures; one said leg X-configured truss structure being attached to each leg; a lateral end of each said leg X-configured truss structures being a leg lateral end wherein said upper end is pivotally connected to said leg upper portion top end and said lower end is pivotally connected to said leg sliding member; and a second side structure of a second plurality of said X-configured truss structures connecting said second pair of adjacent legs; at least one of said lateral ends of each of said second plurality being a joining lateral end wherein said upper end and said lower end respectively are pivotally connected to a said upper end and a said lower end of a joining lateral end of another of said second plurality; said second plurality including a pair of leg X-configured truss structures; one said leg X-configured truss structure being attached to each leg; a lateral end of each said leg X-configured truss structures being a leg lateral end wherein said upper end is pivotally connected to said leg upper portion top end and said lower end is pivotally connected to said leg sliding member;

a central structure connecting between said first side structure and said second side structure and supported thereby; said central structure comprising:

a center post assembly including:

a center post including:

a lower portion including;

a lower terminus; and an upper portion above said lower portion including:

a slider stop; and a center slider member adapted to slide over said center post and to be stopped from further downward movement by said slider stop; and a plurality of center trusses; each center truss connected to an X-configured truss structure of an associated side structure and supported thereby; each center truss comprising:

a long link including:

an outer end pivotally connected to a said lower end of the said joining lateral end of its said associated X-configured truss structure;

an inner end pivotally connected to said center slider member; and a midsection therebetween;

an outer link including:

an outer end pivotally connected to a said upper end of the said joining lateral end of its said associated X-configured truss structure; and an inner end pivotally connected to said midsection of its said long link; and an inner link including:

an outer end pivotally connected to said midsection of its said long link inside of said inner end of said outer link; and an inner end pivotally connected to said lower portion of said center post; said plurality of center trusses including:

a first center truss connected to said first plurality and supported thereby; said first center truss comprising:

a long link including:

an outer end pivotally connected to said lower end of a said joining lateral end of said first plurality;

an inner end pivotally connected to said center slider member; and a midsection therebetween;

an outer link including:

an outer end pivotally connected to said upper end of the said joining lateral end of said first plurality; and an inner end pivotally connected to said midsection of said long link of said first center truss; and an inner link including:

an outer end pivotally connected to said midsection of said long link of said first center truss inside of said inner end of said outer link of said first center truss; and an inner end pivotally connected to said lower portion of said center post; and a second center truss connected to said second plurality and supported thereby; said second center truss comprising:

a long link including:

an outer end pivotally connected to said lower end of a said joining lateral end of said second plurality;

an inner end pivotally connected to said center slider member; and a midsection therebetween;

an outer link including:

an outer end pivotally connected to said upper end of the said joining lateral end of said second plurality; and an inner end pivotally connected to said midsection of said long link of said second center truss; and an inner link including:

an outer end pivotally connected to said midsection of said long link of said second center truss inside of said inner end of said outer link of said second center truss; and an inner end pivotally connected to said lower portion of said center post.

2. The collapsible canopy support of claim 1 wherein said plurality of side structures includes additional side structures connecting said plurality of legs to form a peripheral structure.

3. The collapsible canopy support of claim 2 wherein said plurality of center trusses includes additional center trusses associated with said additional side structures.

4. The collapsible canopy support of claim 1 wherein:

said long link is longer than said second link.

5. The collapsible canopy support of claim 1 wherein:

said center post includes:

a telescoping upper portion; and wherein:

said center post assembly includes;

means for adjusting the length of said center post.

6. A collapsible canopy support comprising:

a peripheral structure comprising:

four legs; each leg including:

an upper portion including;

a top end; and a central portion below said top end;

a lower portion for engagement with the ground; and four sliding members; a sliding member slidingly connected to each said leg central portion; and four pairs of X-configured truss structures connecting said legs; each X-configured truss structure of each pair of X-configured truss structures comprising:

a first link including:

a proximal end pivotally connected to a leg upper portion top end;

a distal end pivotally connected to said distal end of said first link of the other said X-configured truss structure of the pair; and a center portion therebetween; and a second link including:

a proximal end pivotally connected to the leg sliding member;

a distal end pivotally connected to said distal end of said second link of the other said X-configured truss structure of the pair; and a center portion therebetween pivotally connected to said center portion of said first link; and a central structure connecting between opposite side X-configured truss structure pairs and supported thereby; said central structure comprising:

a center post assembly including:

a center post including:

a lower portion including;

a lower terminus; and an upper portion above said lower portion including:

a slider stop; and a center slider member adapted to slide over said center post and to be stopped from further downward movement by said slider stop; and a pair of center trusses connected to opposite side X-configured truss structure pairs and supported thereby; each center truss comprising:

a long link including:
an outer end pivotally connected to said distal ends of said first links of an X-configured truss structure pair;
an inner end pivotally connected to said center slider member; and
a midsection therebetween;
an outer link including:
an outer end pivotally connected to said distal ends of said second links of the X-configured truss structure pair; and
an inner end pivotally connected to said midsection of said long link; and
an inner link including:
an outer end pivotally connected to said midsection of said long link inside of said inner end of said outer link; and
an inner end pivotally connected to said lower portion of said center post.

7. The collapsible canopy support of claim 6 further including:
a second pair of center trusses connected to the other opposite side X-configured truss structure pairs and supported thereby.

8. The collapsible canopy support of claim 6 wherein:
said long link is longer than said second link.

9. The collapsible canopy support of claim 8 wherein:
said inner link is less than half the length of said first link.

10. The collapsible canopy support of claim 6 wherein:
said center post includes:
a telescoping upper portion; and wherein:
said center post assembly includes;
means for adjusting the length of said center post.

11. The collapsible canopy support of claim 6 wherein:
said inner end of said outer link is pivotally connected to said midsection of said long link so as to define an outer portion of said long link, such that the length of said outer link plus the length of said outer portion of said long link approximates the combined length of said first link and said second link from their said proximal ends to the pivot connection of their said center portions.

12. The collapsible canopy support of claim 11 further including:
a second pair of center trusses connected to the other opposite side X-configured truss structure pairs and supported thereby.

13. A canopy support movable between a collapsed configuration and an erect configuration; said canopy support comprising:
a peripheral structure comprising:
four legs; each leg including:
an upper portion including;
a top end; and
a central portion below said top end;
a lower portion for engagement with the ground; and
four sliding members; a sliding member slidingly connected to each said leg central portion; and
four pairs of X-configured truss structures connecting said legs; each X-configured truss structure of each pair of X-configured truss structures comprising:
a first link including:
a proximal end pivotally connected to a leg upper portion top end;
a distal end pivotally connected to said distal end of said first link of the other said X-configured truss structure of the pair; and
a center portion therebetween; and
a second link including:
a proximal end pivotally connected to the leg sliding member;
a distal end pivotally connected to said distal end of said second link of the other said X-configured truss structure of the pair; and
a center portion therebetween pivotally connected to said center portion of said first link; and
a central structure connecting between opposite side X-configured truss structure pairs and supported thereby; said central structure comprising:
a center post assembly including:
a center post including:
a lower portion including;
a lower terminus; and
an upper portion above said lower portion including:
a slider stop; and
a center slider member adapted to slide over said center post and to be stopped from further downward movement by said slider stop; and
a pair of center trusses connected to opposite side X-configured truss structure pairs and supported thereby; each center truss comprising:
a long link having a length longer than the length of said second link; said long link including:
an outer end pivotally connected to said distal ends of said first links of an X-configured truss structure pair;
an inner end pivotally connected to said center slider member; and
a midsection therebetween;
an outer link including:
an outer end pivotally connected to said distal ends of said second links of the X-configured truss structure pair; and
an inner end pivotally connected to said midsection of said long link; and
an inner link including:
an outer end pivotally connected to said midsection of said long link; and
an inner end pivotally connected to said lower portion of said center post; wherein
said slider stop stops said center slider member such that said inner end of said long link is higher than said distal ends of said second links.

14. The collapsible canopy support of claim 13 wherein:
said lower terminus of said center post assembly is higher than said distal ends of said first links.

15. The collapsible canopy support of claim 13 wherein:
said center post assembly includes;
means for adjusting the length of said center post.

16. The collapsible canopy support of claim 13 further including:
a second pair of center trusses connected to the other opposite side X-configured truss structure pairs and supported thereby.

17. A collapsible canopy support comprising:
a plurality of legs; each leg including:
an upper portion including;
a top end;
a central portion below said top end;
a lower portion for engagement with the ground; and
a sliding member slidingly connected to said leg central portion; said plurality of legs including:

a first pair of adjacent legs including:
a first leg; and
a second leg; and
a second pair of adjacent legs including:
a first leg; and
a second leg;
a plurality of side structures; each side structure joining two legs and including:
a plurality of X-configured truss structures; each X-configured truss structure comprising:
a first link including:
an upper end;
a lower end; and
a center portion;
a second link including:
an upper end;
a lower end; and
a center portion pivotally connected to said center portion of said first link; such that each X-configured truss structure has lateral ends; each said lateral end comprising an upper end of one said link and a lower end of the other said link; said plurality of X-configured truss structures including:
a first side structure of a first plurality of said X-configured truss structures connecting said first pair of adjacent legs; at least one said lateral end of each of said first plurality being a joining lateral end wherein said upper end and said lower end respectively are pivotally connected to a said upper end and a said lower end of a joining lateral end of another of said first plurality; said first plurality including a pair of leg X-configured truss structures; one said leg X-configured truss structure being attached to each leg; a lateral end of each said leg X-configured truss structures being a leg lateral end wherein said upper end is pivotally connected to said leg upper portion top end and said lower end is pivotally connected to said leg sliding member; and
a second side structure of a second plurality of said X-configured truss structures connecting said second pair of adjacent legs; at least one of said lateral ends of each of said second plurality being a joining lateral end wherein said upper end and said lower end respectively are pivotally connected to a said upper end and a said lower end of a joining lateral end of another of said second plurality; said second plurality including a pair of leg X-configured truss structures; one said leg X-configured truss structure being attached to each leg; a lateral end of each said leg X-configured truss structures being a leg lateral end wherein said upper end is pivotally connected to said leg upper portion top end and said lower end is pivotally connected to said leg sliding member;
a central structure connecting between said first side structure and said second side structure and supported thereby; said central structure comprising:
a center post assembly including:
a center post including:
a lower portion including;
a lower terminus; and
an upper portion above said lower portion including:
a slider stop; and
a center slider member adapted to slide over said center post and to be stopped from further downward movement by said slider stop; and
a plurality of center trusses; each center truss connected to an X-configured truss structure of an associated side structure and supported thereby; each center truss comprising:
a long link including:
an outer end pivotally connected to a said lower end of the said joining lateral end of its said associated X-configured truss structure;
an inner end pivotally connected to said center slider member; and
a midsection therebetween;
an outer link including:
an outer end pivotally connected to a said upper end of the said joining lateral end of its said associated X-configured truss structure; and
an inner end pivotally connected to said midsection of its said long link; and
an inner link including:
an outer end pivotally connected to said midsection of its said long link; and
an inner end pivotally connected to said lower portion of said center post; said plurality of center trusses including:
a first center truss connected to said first plurality and supported thereby; said first center truss comprising:
a long link; said long link being longer than said second link; said long link including:
an outer end pivotally connected to said lower end of a said joining lateral end of said first plurality;
an inner end pivotally connected to said center slider member; and
a midsection therebetween;
an outer link including:
an outer end pivotally connected to said upper end of the said joining lateral end of said first plurality; and
an inner end pivotally connected to said midsection of said long link of said first center truss; and
an inner link including:
an outer end pivotally connected to said midsection of said long link of said first center truss; and
an inner end pivotally connected to said lower portion of said center post; and
a second center truss connected to said second plurality and supported thereby; said second center truss comprising:
a long link including:
an outer end pivotally connected to said lower end of a said joining lateral end of said second plurality;
an inner end pivotally connected to said center slider member; and
a midsection therebetween;
an outer link including:
an outer end pivotally connected to said upper end of the said joining lateral end of said second plurality; and
an inner end pivotally connected to said midsection of said long link of said second center truss; and
an inner link including:
an outer end pivotally connected to said midsection of said long link of said second center truss; and
an inner end pivotally connected to said lower portion of said center post.

18. The collapsible canopy support of claim 17 wherein said plurality of side structures includes additional side structures connecting said plurality of legs to form a peripheral structure.

19. The collapsible canopy support of claim 18 wherein said plurality of center trusses includes additional center trusses associated with said additional side structures.

20. The collapsible canopy support of claim 17 wherein:

said center post includes:

a telescoping upper portion; and wherein:

said center post assembly includes;

means for adjusting the length of said center post.

21. A collapsible canopy support comprising:

a peripheral structure comprising:

four legs; each leg including:

an upper portion including;

a top end; and a central portion below said top end;

a lower portion for engagement with the ground; and four sliding members; a sliding member slidingly connected to each said leg central portion; and four pairs of X-configured truss structures connecting said legs; each X-configured truss structure of each pair of X-configured truss structures comprising:

a first link including:

a proximal end pivotally connected to a leg upper portion top end;

a distal end pivotally connected to said distal end of said first link of the other said X-configured truss structure of the pair; and a center portion therebetween; and a second link including:

a proximal end pivotally connected to the leg sliding member;

a distal end pivotally connected to said distal end of said second link of the other said X-configured truss structure of the pair; and a center portion therebetween pivotally connected to said center portion of said first link; and a central structure connecting between opposite side X-configured truss structure pairs and supported thereby; said central structure comprising:

a center post assembly including:

a center post including:

a lower portion including;

a lower terminus; and an upper portion above said lower portion including:

a slider stop; and a center slider member adapted to slide over said center post and to be stopped from further downward movement by said slider stop; and a pair of center trusses connected to opposite side X-configured truss structure pairs and supported thereby; each center truss comprising:

a long link; said long link being longer than said second link; said long link including:

an outer end pivotally connected to said distal ends of said first links of an X-configured truss structure pair;

an inner end pivotally connected to said center slider member; and a midsection therebetween;

an outer link including:

an outer end pivotally connected to said distal ends of said second links of the X-configured truss structure pair; and an inner end pivotally connected to said midsection of said long link; and an inner link including:

an outer end pivotally connected to said midsection of said long link; and an inner end pivotally connected to said lower portion of said center post.

22. The collapsible canopy support of claim 21 further including:

a second pair of center trusses connected to the other opposite side X-configured truss structure pairs and supported thereby.

23. The collapsible canopy support of claim 21 wherein:

said inner link is less than half the length of said first link.

24. The collapsible canopy support of claim 21 wherein:

said center post includes:

a telescoping upper portion; and wherein:

said center post assembly includes;

means for adjusting the length of said center post.

25. The collapsible canopy support of claim 21 wherein:

said inner end of said outer link is pivotally connected to said midsection of said long link so as to define an outer portion of said long link, such that the length of said outer link plus the length of said outer portion of said long link approximates the combined length of said first link and said second link from their said proximal ends to the pivot connection of their said center portions.

26. The collapsible canopy support of claim 25 further including:

a second pair of center trusses connected to the other opposite side X-configured truss structure pairs and supported thereby.

* * * * *